US008231406B2

(12) United States Patent
Burris et al.

(10) Patent No.: US 8,231,406 B2
(45) Date of Patent: Jul. 31, 2012

(54) RF TERMINATOR WITH IMPROVED ELECTRICAL CIRCUIT

(75) Inventors: Donald Andrew Burris, Peoria, AZ (US); Irven Chien, Sanchong (TW)

(73) Assignee: Corning Gilbert Inc., Glendale, AZ (US)

( * ) Notice: Subject to any disclaimer, the term of this patent is extended or adjusted under 35 U.S.C. 154(b) by 371 days.

(21) Appl. No.: 12/582,992

(22) Filed: Oct. 21, 2009

(65) Prior Publication Data

US 2010/0105246 A1 Apr. 29, 2010

Related U.S. Application Data

(60) Provisional application No. 61/109,301, filed on Oct. 29, 2008.

(51) Int. Cl.
*H01R 9/05* (2006.01)

(52) U.S. Cl. ..... 439/578; 439/620.13; 439/620.21

(58) Field of Classification Search ..... 439/578, 439/620.04, 620.13, 620.03, 620.21, 620.22
See application file for complete search history.

(56) References Cited

U.S. PATENT DOCUMENTS

| | | | | |
|---|---|---|---|---|
| 3,519,979 | A | 7/1970 | Bodenstein | 339/85 |
| 3,573,702 | A | 4/1971 | O'Keefe | 338/220 |
| 3,768,063 | A | 10/1973 | Coffman | 339/31 R |
| 3,845,454 | A | 10/1974 | Hayward et al. | 339/85 |
| 3,890,028 | A | 6/1975 | Blanchenot | 339/85 |
| 4,469,386 | A | 9/1984 | Ackerman | 339/37 |
| 4,897,008 | A | 1/1990 | Parks | 411/432 |
| 5,011,422 | A | 4/1991 | Yeh | 439/307 |
| 5,055,060 | A | 10/1991 | Down et al. | 439/304 |
| 5,106,312 | A | 4/1992 | Yeh | 439/133 |
| 5,179,877 | A | 1/1993 | Down et al. | 81/443 |
| 5,217,391 | A * | 6/1993 | Fisher, Jr. | 439/578 |
| 5,273,444 | A | 12/1993 | Down et al. | 439/133 |
| 5,435,736 | A | 7/1995 | McMills et al. | 439/133 |
| 5,564,938 | A | 10/1996 | Shenkal et al. | 439/301 |
| 5,655,915 | A | 8/1997 | McMills et al. | 439/133 |
| 5,887,452 | A | 3/1999 | Smith et al. | 66/170 |
| 6,089,912 | A | 7/2000 | Tallis et al. | 439/584 |
| 6,334,791 | B1 * | 1/2002 | Yeh | 439/620.03 |
| 6,491,546 | B1 | 12/2002 | Perry | 439/620 |
| 6,776,912 | B2 | 8/2004 | Baurmeister | 210/646 |
| 6,887,103 | B2 | 5/2005 | Montena et al. | 439/583 |
| 7,144,271 | B1 * | 12/2006 | Burris et al. | 439/578 |
| 7,488,210 | B1 | 2/2009 | Burris et al. | 439/578 |

FOREIGN PATENT DOCUMENTS

| | | |
|---|---|---|
| DE | 26 04 972 A1 | 8/1977 |
| DE | 38 16 913 A1 | 11/1989 |
| DE | 295 12 537 U1 | 9/1995 |
| EP | 1 337 134 A2 | 8/2003 |

* cited by examiner

*Primary Examiner* — Tulsidas C Patel
*Assistant Examiner* — Travis Chambers
(74) *Attorney, Agent, or Firm* — Matthew J. Mason

(57) ABSTRACT

An RF coaxial terminator includes an impedance match element mounted within a housing. The impedance match element includes a central conductive pin, a supportive element, a ring, and a resistor, wherein the resistor longitudinally extends in a direction that is not coaxial with the longitudinal axis of the central conductive pin.

19 Claims, 4 Drawing Sheets

RF TERMINATOR WITH IMPROVED ELECTRICAL CIRCUIT

CROSS-REFERENCE TO RELATED APPLICATIONS

This application claims the benefit of, and priority to U.S. Provisional Patent Application No. 61/109,301 filed on Oct. 29, 2008 entitled, "RF Terminator with Improved Electrical Circuit", the content of which is relied upon and incorporated herein by reference in its entirety.

BACKGROUND OF THE INVENTION

1. Field of the Invention

The present invention relates generally to terminators and CATV coaxial connectors, and more particularly, to a terminator having an improved construction.

2. Technical Background

Cable transmission systems are in wide use throughout the world for transferring television signals, and other types of signals, between devices. For example, a typical CATV system utilizes coaxial cables to provide signal communication between a head end and distributed receiver sets. A conventional CATV system includes a permanently installed cable extending from the head end throughout the area to be served. Various devices, such as directional taps, are spaced along the cable. Individual subscribers are serviced by a drop cable connected to a selected terminal of an equipment box or other device. The terminals that extend from the equipment box are externally threaded female coaxial ports designed to receive a conventional F-connector provided at the end of the drop cable. A terminator is typically affixed to each of the unused terminals of the equipment to maintain proper impedance along the signal transmission path.

In some cases, the equipment to which the drop cables are connected must be located in public areas, and the terminals may be readily accessible to the public. Such circumstances might permit unauthorized persons to move a drop cable from one port to another port, diverting service from a paying subscriber to a non-paying user. In an effort to prevent unauthorized access to the system, suppliers to the CATV industry have provided a type of terminator referred to as tamper-resistant or theft-proof Typical examples of such tamper resistant terminators are shown and described in U.S. Pat. No. 3,845,454 (Hayward, et al.); U.S. Pat. No. 3,519,979 (Bodenstein); U.S. Pat. No. 4,469,386 (Ackerman); U.S. Pat. No. 5,055,060 (Down); U.S. Pat. No. 5,106,312 (Yeh); U.S. Pat. No. 6,491,546 (Perry); and U.S. Pat. No. 7,144,271 (Burris, et al). A special tool, not generally available to the public, is required for installation and removal of such tamper resistant terminators from the equipment ports to which they are attached.

In other cases, the equipment to which the drop cables are connected are located in relatively secure areas and do not required a tamper-proof termination system. Terminators applied in such applications are typically more simplified in their design and, as a result, are of lower cost.

In either case, the current state of the art has been to employ a cylindrical carbon type resistive element that is axially in-line with the components comprising the terminator assembly. The overall length of the resistive element and the cylindrical nature of the design of the resistive element necessitate the use of correspondingly long related components resulting in a relatively long assembly. Electrical tuning of this type of arrangement is somewhat limited by the structural aspect of the arrangement of components and is further limited by the nature of the resistive element itself. Additionally, it is typical to mount the resistive element within a separate component, or holder, often attached to the resistive element by means of a solder joint and is then in turn assembled within the final assembly by means of a press fit. In such configurations, the diameter of the electrical lead of the resistive element is typically required to be less than the diameter of the cable center conductor it is intended to emulate.

SUMMARY OF THE INVENTION

One aspect of the invention includes a coaxial terminator for securing and terminating a coaxial equipment port of an equipment box. The coaxial equipment port is of the type having a female center conductor adapted to receive a center conductor of a coaxial connector. The coaxial equipment port is also of the type including an externally threaded outer conductor surrounding the female center conductor and spaced apart therefrom by a dielectric. The coaxial terminator includes a housing having first and second opposing ends, the first end of the housing having a central bore, and the first end of the housing including an internally threaded region to threadedly engage the outer conductor of the coaxial equipment port through rotation of the housing relative to the coaxial equipment port. The coaxial terminator further includes an impedance match element mounted within the housing. The impedance match element includes a conductive ring that is in electrical and mechanical communication with the housing, a central conductive pin having first and second opposing ends, a supportive element, and a resistor having first and second opposing ends, wherein the resistor is in electrical communication with the central conductive pin and wherein the resistor longitudinally extends in a direction that is not coaxial with the longitudinal axis of the central conductive pin. The supportive element includes a first area of conductive material in electrical and mechanical communication with the central conductive pin and the resistor. The supportive element also includes a second area of conductive material that includes at least one area in electrical and mechanical communication with the conductive ring and the resistor. The impedance match element preferably utilizes conductive element configuration, electrical trace element configuration, resistor placement, and solder attachment methods to provide enhanced RF electrical performance and yet is manufacturable using high volume production methods.

In a preferred embodiment, the housing includes an internal body and an outer body surrounding the internal body and rotatably secured thereover. The internal body has first and second opposing ends and the first end of the internal body includes the internally threaded region to threadedly engage the outer conductor of the coaxial equipment. The outer body has first and second opposing ends and the second end of the outer body can have a bore formed therein for allowing the insertion of a tool to rotate the internal body, wherein the impedance match element is mounted within the internal body.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
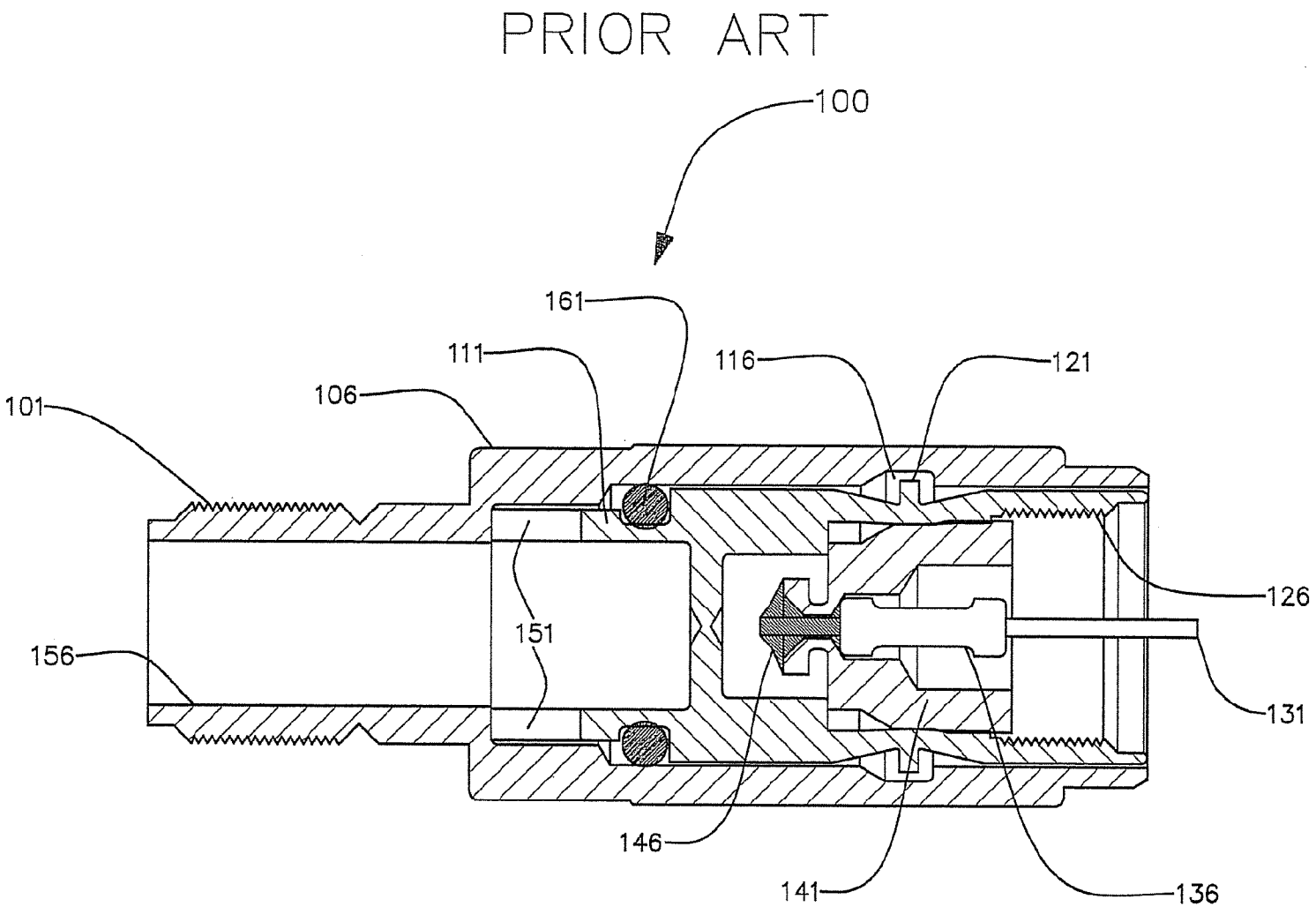
FIG. 1 is a partial cutaway view along the centerline of a prior art Type F terminator similar to what is disclosed in U.S. Pat. No. 7,144,271.

Reference will now be made in detail to the present preferred embodiment(s) of the invention, examples of which are illustrated in the accompanying drawings. Whenever possible, the same reference numerals will be used throughout the drawings to refer to the same or like parts.

As used herein, the terms "longitudinal" and "longitudinally" refer to the longest dimension of a three-dimensional object or component.

In preferred embodiments, the present invention can provide an RF terminator having a reduced length (thereby reducing the overall amount of material required and, hence, cost). In addition, reduced length can reduce cantilever forces that may be applied to an equipment port, which can provide a more robust, or less prone to breakage system. In preferred embodiments, the present invention may also provide an RF terminator that is highly tunable and contains a center conductor that emulates related cable while still providing at least one positive feature or benefit of prior product offerings, such as use with standardized security tooling and/or weather sealing where required.

FIG. 1 is a partial cutaway view along the centerline of a prior art Type F terminator similar to what is disclosed in U.S. Pat. No. 7,144,271. FIG. 1 illustrates a tamper resistant coaxial terminator 100 for securing and terminating a coaxial equipment port of an equipment box. The tamper resistant coaxial terminator 100 includes an outer shield 106, an internally-threaded RF port 126, a resistor 136, an o-ring 161, and an inner body 111. Resistor 136 is housed within the central bore of an RF port member 141 and extends between first a central conductive pin 131 (for being inserted within the female center conductor of the coaxial equipment port) and a solder joint 146, which electrically and mechanically couples resistor 136 to RF port member 141.

RF port member 141 is typically press-fit into inner body 111. Inner body 111 has slotted surfaces 151, for receiving a special tool used to rotate inner body 111. In addition, inner body 111 includes a bowed, thinned region which has an outwardly-extending external circular rib 121 within an annular recess 116 of outer shield 106.

Outer shield 106 surrounds inner body 111 and is rotatably secured over inner body 111 and includes an inner surface defining a smaller diameter central bore 156, formed therein for allowing insertion of a working end of an installation tool to rotate inner body 111. As further shown in FIG. 1, outer shield 106 typically has external threads 101 formed thereon to attach a disconnected drop cable thereto.

Figure 2:
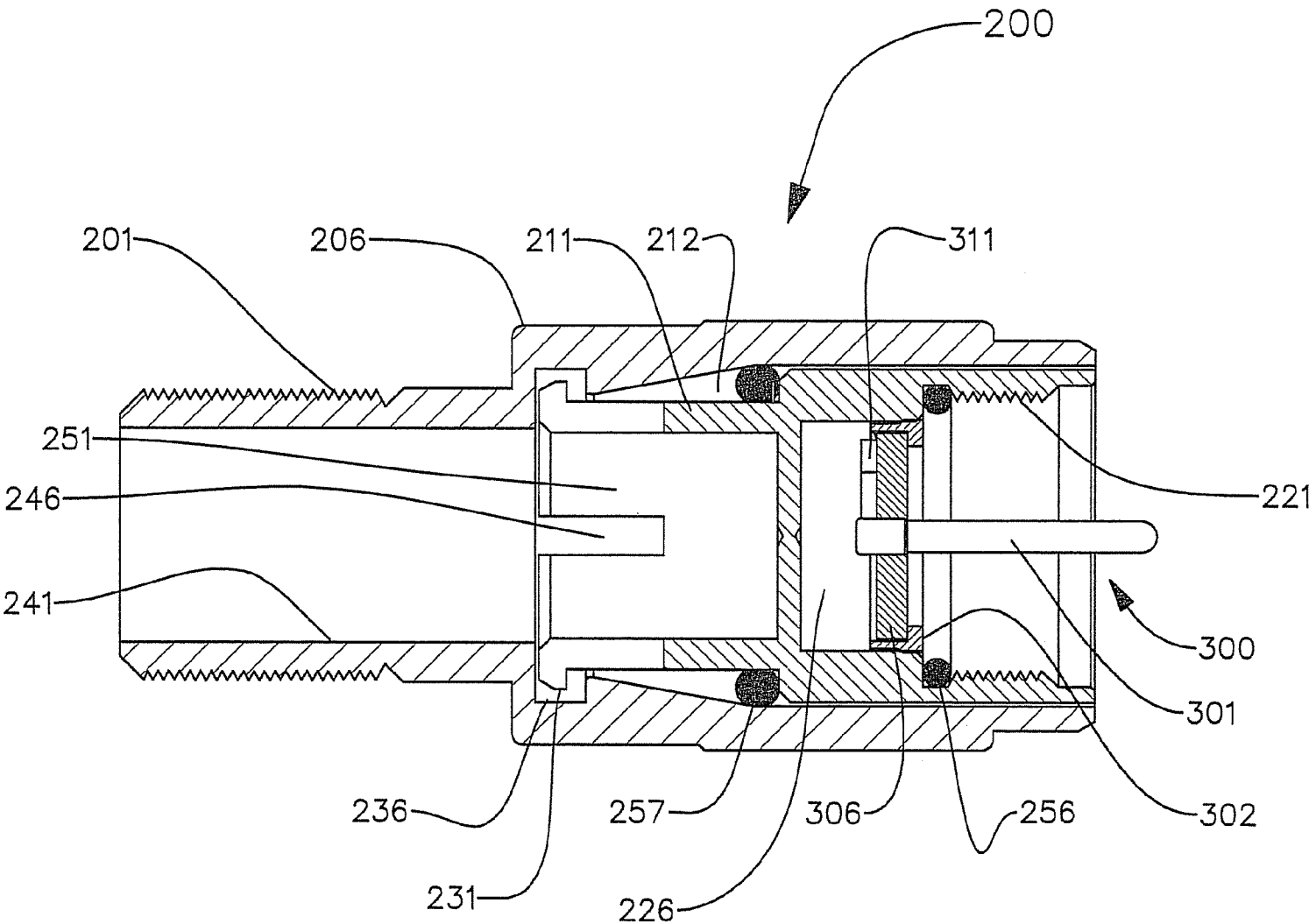
FIG. 2 is a side cutaway view along the centerline of a preferred embodiment of a terminator in accordance with the invention.

FIG. 2 schematically illustrates one preferred embodiment of an RF terminator 200, as disclosed herein, comprising a housing that includes an outer body 206 and an internal body 211. Outer body 206 further comprises an external threaded area 201, an internal cavity 212, an internal annular groove 236, and a bore 241. Outer body 206 is preferably constructed from a metal or metal alloy, wherein the metal or metal alloy includes a metal such as zinc, and is preferably plated with a corrosion resistant material such as nickel. Internal body 211 comprises an internal threaded area 221, a cavity 226, a bore 251, and a multiplicity of slots 246. Internal body 211 is preferably constructed from a metal or metal alloy (such as brass) and is preferably plated with a corrosion resistant material such as nickel. Internal body 211 provides electrical path and mechanical mounting for an impedance match element 300. Impedance match element 300 is retained within internal body 211, by means of a mechanical interference fit with ring 302. Impedance match element 300 comprises a pin 301 preferably constructed from a metal alloy such as brass or from a metal such as copper and is preferably plated with a conductive material such as tin.

Alternatively, pin 301 may be constructed from copper clad steel and plated with a conductive material such as tin.

Impedance match element 300 further comprises ring 302, which is preferably constructed from a metal alloy, such as brass, and is preferably plated with a conductive material, such as tin. Impedance match element 300 further comprises a supportive element 306, such as a printed circuit board ("PC board"), which is a copper clad epoxy-glass material known to the industry. Impedance match element 300 further comprises a resistor 311, such as a thick-film chip resistor commercially available from any number of sources including Dale Electronics of Norfolk, Nebr. or Amitron of North Andover, Mass. Resistor 311, in a preferred embodiment, includes a coated ceramic block.

Inner body 211 is preferably forced into outer body 206 during factory assembly. Segments or fingers formed by a plurality of slots 246 form radially inwardly to allow an annular shoulder 231 to pass into annular groove 236. Once positioned, segments or fingers formed by a plurality of slots 246 are formed radially outwardly in a factory assembly process thereby rotatably capturing inner body 211 within outer body 206. Axial movement between inner body 211 and outer body 206 is limited by the axial relationship of annular shoulder 231 and annular groove 236. Internal threaded area 221 provides mechanical coupling with corresponding mating components. Bore 241 and bore 251 allow entry of a security tool, which can rotate inner body 211 relative to outer body 206. A plurality of slots 246 engage said security tool to enable rotation of inner body 211. An optional o-ring 256 is illustrated within a recess in the inner body 211 at the distal end of internal threaded area 221. Another optional o-ring 257 is installed about inner body 211 within cavity 212 to block moisture migration through the inside contours of outer body 206.

Impedance match element 300 may be electrically tuned in conjunction with cavity 226 to provide enhanced RF performance as described in the following paragraphs.

Figure 3A:
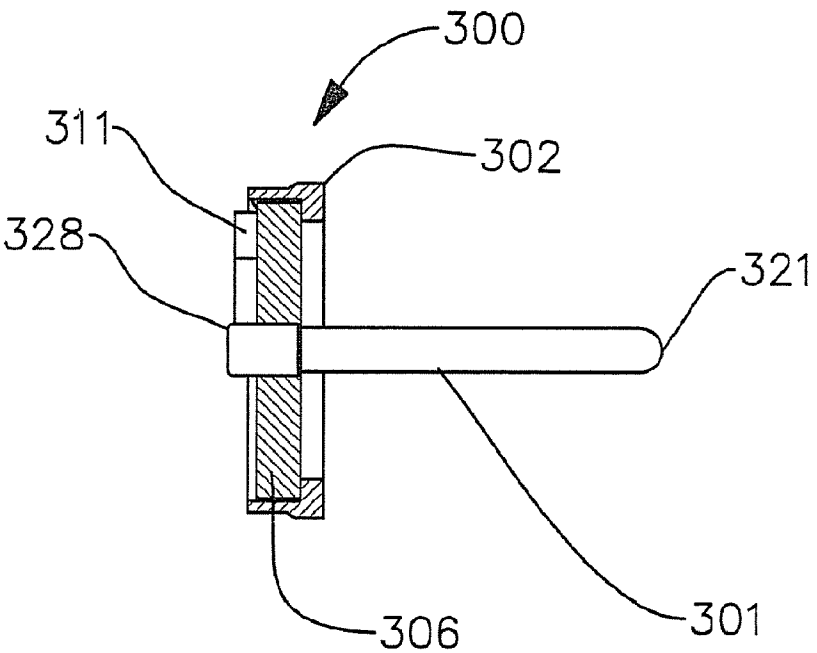
FIG. 3A is a side cutaway view of an impedance match element for use in a terminator in accordance with the invention.

FIG. 3A is a side cutaway view of impedance match element 300 comprising pin 301, supportive element 306, resistor 311 and ring 302. Pin 301 is preferably radiused at end 321 or, alternatively, chamfered. Pin 301 is preferably stamped, or coined with flats on two sides producing an ovoid shape proximate said flats at distal end 328. The coined shape at distal end 328 provides a means to at least partially press-fit pin 301 into supportive element 306.

Figure 3B:
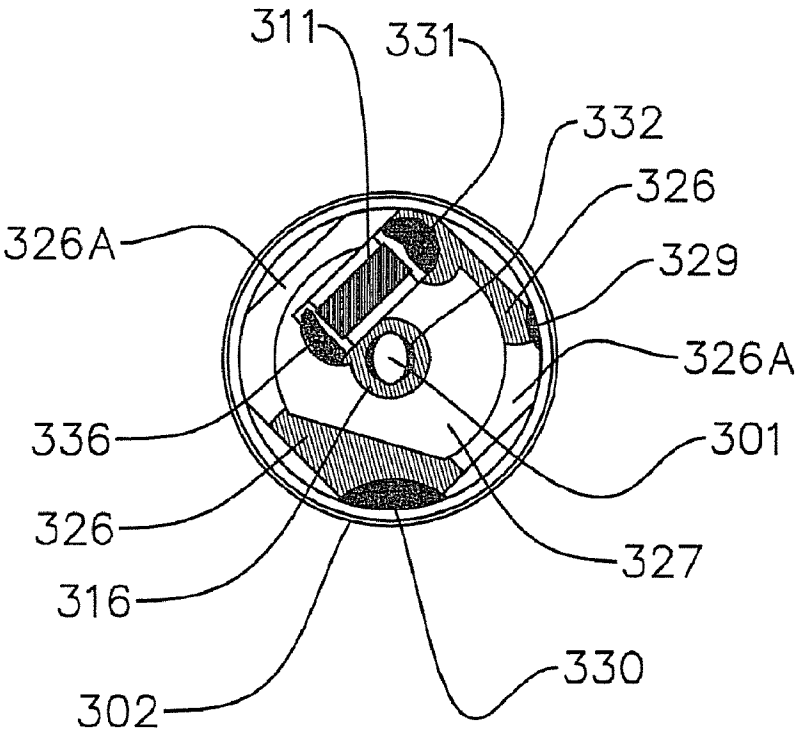
FIG. 3B is a perspective view of the distal end of an impedance match element for use in a terminator in accordance with the invention.

Turning to FIG. 3B, pin 301 is preferably press-fit through supportive element 306 and, in a preferred embodiment, is in electrical communication with resistor 311 by means of solder attachment with resistor 311 and copper clad traces 316 and 326. In a preferred embodiment, pin 301 may also be in mechanical communication with resistor 311. In a preferred embodiment, pin 301 may also be in mechanical communication with copper clad trace 316, which along with copper clad trace 326, can be in mechanical communication with resistor 311. In a preferred embodiment, resistor 311 may also be in mechanical communication with supportive element 306. Pin 301 diameter is preferably 0.040 inches, ±0.005 inches (0.040 inches corresponds to the diameter of a Series 6 coaxial cable center conductor and is larger than conventional terminators, which typically have a 0.025 inch diameter resistor lead that is used as a center conductor-conventional terminators typically have center conductor diameters that do not exceed about 0.025 inches due to the difficulty of maintaining 75 ohm impedance through a cylindrical resistor with a relatively larger wire). Accordingly, pin 301 can provide an advantage not available in current terminator designs, namely that by mimicking the diameter of a Series 6 cable center conductor, better electrical and mechanical communication with a mating port can be achieved. A further advantage is found in embodiments where pin 301 is radiused at 321 (conventionally, terminators with cylindrical resistors are provided with long lead wires, which are trimmed in application to a desired length, which results in a sharp edge and an unplated portion of the lead wire). Radius at end 321 eases insertion with a mating part as opposed to the sharp edges normally found on resistor leads. Yet a further advantage may be found in embodiments where pin 301 is provided with uninterrupted tin plating covering the entire component with no exposed base material.

Supportive element 306, in a preferred embodiment is a PC board, which is a copper clad epoxy-glass material known to the industry. Supportive element 306 preferably comprises a copper clad trace elements 316 and 326 on the distal side as illustrated in FIG. 3B which are bridged by resistor 311. Trace elements 316 and 326 and resistor 311 are preferably soldered at 331 and 336. Alternatively, trace elements 316 and 326 and resistor 311 may be electrically and mechanically joined at 331 and 336 by means of a conductive adhesive. Trace element 326 is preferably soldered to ring 302 at 329 and 330. Alternatively, trace element 326 may be electrically and mechanically joined at 329 and 330 by means of a conductive adhesive. Trace element 316 is preferably soldered to pin 301 at 332. Alternatively, trace element 316 may be electrically and mechanically joined at 332 by means of a conductive adhesive.

Trace element 326 is in electrical and mechanical communication with ring 302 via solder, mechanical fit, or adhesive, and ring 302 is, in turn, in electrical and mechanical communication with housing or inner body 211 to provide an electrical path to ground and/or a mating port interface. Alternatively, another trace element can be utilized on the proximal side of supportive element 306 and joined with trace element 326 by means of through-board via holes or the like creating an alternate ground plane or planes. Use of a secondary or alternate ground plane allows the possibility that inner body 211 to be made from plastic or other non-conductive material further reducing component costs.

Supportive element 306 may be round, hexagonal, square, or virtually any geometric shape. Preferably, resistor 311 longitudinally extends radially along at least a portion of supportive element 306, as shown in FIG. 3B. Preferably, resistor 311 longitudinally extends in a direction that is perpendicular to the longitudinal axis of pin 301 but may longitudinally extend in any direction that is not coaxial with the longitudinal axis of pin 301. In other words, resistor 311 preferably longitudinally extends at a right angle (i.e., 90 degrees) to the longitudinal axis of pin 301 but may alternatively longitudinally extend at other angles that are not coaxial with the longitudinal axis of pin 301 (such as any angle between 10 degrees and 170 degrees, including any angle between 45 degrees and 135 degrees, and further including any angle between 80 degrees and 100 degrees).

Trace element 326 preferably circumscribes supportive element 306, is preferably separated from trace element 316 by non-conductive area 327, and preferably includes one or more areas 326A that are covered by a shielding material and one or more areas 326 that are not covered by a shielding material. By "shielding material" we mean a material that prevents solder or conductive adhesive from adhering to trace element 326. Examples of shielding material include UV curable solder mask, such as Lite Fast™ available from Micro-Lite Technology (MLT). Areas that are not covered by shielding material can, by contrast, allow for solder or adhesive attachment between trace element 326 and ring 302 in one or more areas, as shown by 329 and 330 in FIG. 3B. Preferably, trace element is covered by shielding material, and is therefore, shielded from solder or adhesive attachment in at least two areas 326A and is not covered by shielding material in at least two separate areas 326, thereby allowing for solder or adhesive attachment only in the areas that are not covered by shielding material. Trace element 316 roughly circumscribes pin 301 to allow solder or adhesive attachment with pin 301 and resistive element 311. The geometric configuration and the shielding or non-shielding of trace element 326 at strategic locations (such as is shown, for example, in FIG. 3B) allows for mechanical and electrical communication between trace element 326 and ring 302 in such a manner as to electrically balance the capacitive and inductive effects of the entire electrical circuit which includes trace elements 326, 326A, and 316 and resistive element 311, solder, pin 301, ring 302, and outer body 211. Said configuration and electrical balancing can allow the RF circuit to be tuned for maximum performance.

Figure 4:
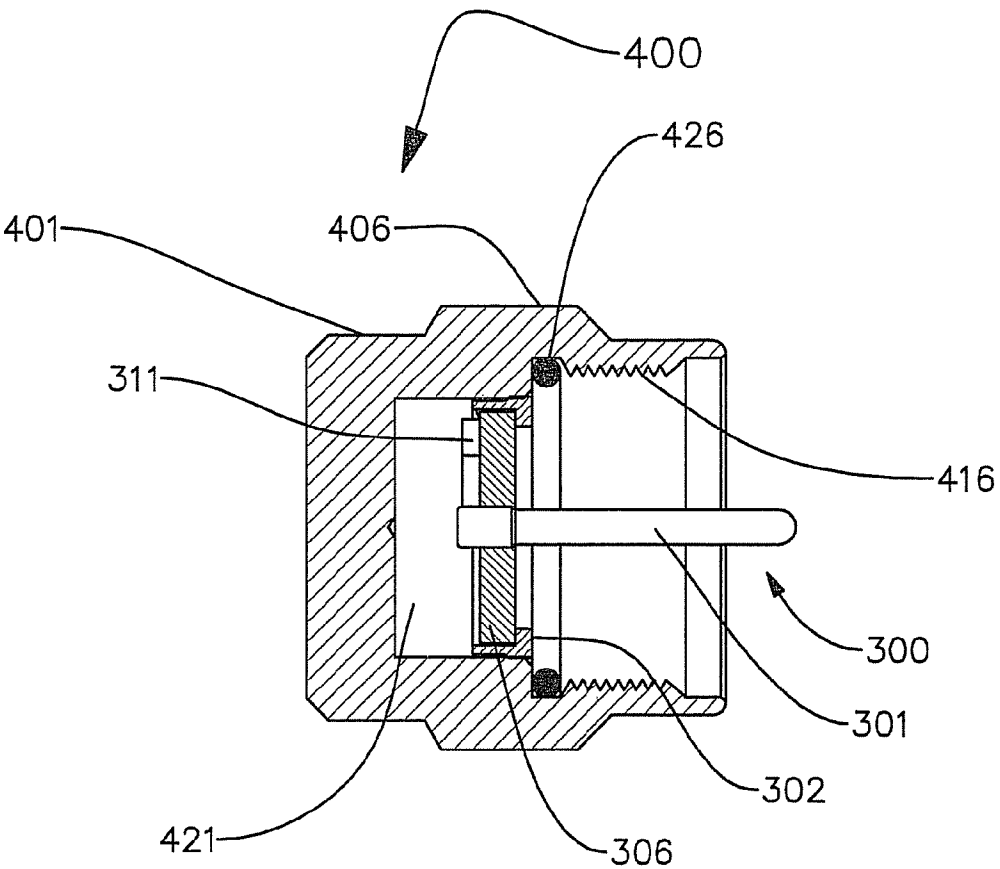
FIG. 4 is a side cutaway view of an alternative embodiment of a terminator in accordance with the invention wherein security features are excluded.

Turning to FIG. 4, wherein terminator 400 comprises impedance match element 300 mounted in a standard (i.e., non-theft-proof) type housing or terminator body 401. Terminator 400 is not intended to be a theft proof or tamper proof design. Terminator 400 encompasses impedance match element 300 comprising pin 301, ring 302, resistor 311, and supportive element 306. Terminator 400 further includes threaded area 416, external hex shape 406, cavity 421 and optional o-ring 426.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A coaxial terminator for securing and terminating a coaxial equipment port of an equipment box, the coaxial equipment port being of the type having a female center conductor adapted to receive a center conductor of a coaxial connector, the coaxial equipment port also being of the type including an externally threaded outer conductor surrounding the female center conductor and spaced apart therefrom by a dielectric, the coaxial terminator comprising:

a housing having first and second opposing ends, the first end of the housing having a central bore, and the first end of the housing including an internally threaded region to threadedly engage the outer conductor of the coaxial equipment port through rotation of the housing relative to the coaxial equipment port; and an impedance match element mounted within said housing, said impedance match element comprising:

a central conductive pin having first and second opposing ends;

a supportive element;

a resistor having first and second opposing ends, wherein the resistor is in electrical communication with the central conductive pin and wherein the resistor longitudinally extends in a direction that is not coaxial with the longitudinal axis of the central conductive pin; and a conductive ring that is in electrical and mechanical communication with said housing;

wherein said supportive element comprises:

a first area of conductive material in electrical and mechanical communication with said central conductive pin and said resistor; and a second area of conductive material comprising at least one area in electrical and mechanical communication with said conductive ring and said resistor, wherein said second area of conductive material comprises at least one area that is covered by a shielding material and at least one area that is not covered by a shielding material.

2. The coaxial terminator of claim 1, wherein at least a portion of the at least one area that is not covered by a shielding material is soldered to the conductive ring.

3. The coaxial terminator of claim 1, wherein the resistor longitudinally extends in a direction that is perpendicular to the longitudinal axis of the central conductive pin.

4. The coaxial terminator of claim 1, wherein the first end of said central conductive pin extends beyond the first end of said housing.

5. The coaxial terminator of claim 1, wherein the housing further comprises a cylindrical cavity between the impedance match element and the second end of the housing, wherein the ratio of the diameter of the cylindrical cavity to the length of the cylindrical cavity ranges from 6:1 to 1:1.

6. The coaxial terminator of claim 1, wherein the resistor comprises a coated ceramic block.

7. The coaxial terminator of claim 1, wherein the supportive element comprises a printed circuit board.

8. The coaxial terminator of claim 1, wherein the total length of the terminator along its longitudinal axis is less than about 0.4 inches.

9. The coaxial terminator of claim 1, wherein central conductive pin has a diameter of 0.040 inches ±0.005 inches.

10. The coaxial terminator of claim 1, wherein the first end of the central conductive pin is radiused.

11. The coaxial terminator of claim 1, wherein the first end of central conductive pin is chamfered.

12. The coaxial terminator of claim 1, wherein said first and second areas of conductive material comprise copper clad traces.

13. The coaxial terminator of claim 1, wherein the housing comprises an internal body and an outer body surrounding the internal body and rotatably secured thereover, the internal body having first and second opposing ends, the first end of the internal body including the internally threaded region to threadedly engage the outer conductor of the coaxial equipment, the outer body having first and second opposing ends, the second end of the outer body having a bore formed therein for allowing the insertion of a tool to rotate the internal body, wherein the impedance match element is mounted within the internal body.

14. The coaxial terminator of claim 1, wherein the terminator provides for a return loss having an absolute value of at least 25 dB.

15. The coaxial terminator of claim 1, wherein said second area of conductive material comprises at least two areas that are covered by a shielding material and at least two areas that are not covered by a shielding material.

16. The coaxial terminator of claim 15, wherein at least a portion of the at least two areas that are not covered by a shielding material are soldered to the conductive ring.

17. The coaxial terminator of claim 1, wherein the second end of the central conductive pin is press-fit through the supportive element.

18. The coaxial terminator of claim 17, wherein the total length of the terminator along its longitudinal axis is less than about 1 inch.

19. The coaxial terminator of claim 17, wherein the second end of an internal body further comprises a plurality of slots for engaging a tool.

* * * * *